US006439343B1

(12) United States Patent
Jorges et al.

(10) Patent No.: US 6,439,343 B1
(45) Date of Patent: Aug. 27, 2002

(54) TWO RUNG REMOVABLE STEP AND METHOD OF USING THE SAME

(76) Inventors: Timothy J. Jorges, 7749 31st St.; Douglas K. Stoffel, 2710 Hamlet Ave., N., both of Oakdale, MN (US) 55128

( * ) Notice: Subject to any disclaimer, the term of this patent is extended or adjusted under 35 U.S.C. 154(b) by 0 days.

(21) Appl. No.: 09/598,114

(22) Filed: Jun. 21, 2000

(51) Int. Cl.[7] ..... E04G 3/00

(52) U.S. Cl. ..... 182/92; 182/90; 182/187; 81/124.2

(58) Field of Search ..... 182/90, 92, 129, 182/221, 187, 188; 248/217.3

(56) References Cited

U.S. PATENT DOCUMENTS

| | | | | | |
|---|---|---|---|---|---|
| 543,121 | A | * | 7/1895 | Bates | 182/92 X |
| 1,588,566 | A | * | 6/1926 | Wismer | 182/92 |
| 3,298,459 | A | * | 1/1967 | Bergsten | 182/92 |
| 3,498,409 | A | * | 3/1970 | Meyer | 182/92 |
| 4,394,881 | A | * | 7/1983 | Shirley | 175/76 |
| 4,415,061 | A | | 11/1983 | Meyer | 182/92 |
| 4,620,610 | A | * | 11/1986 | Southard | 182/92 |
| 4,674,597 | A | * | 6/1987 | Humphrey | 182/92 |
| 4,697,669 | A | * | 10/1987 | Bergsten | 182/92 |
| 4,700,807 | A | * | 10/1987 | Kubiak | 182/92 |
| 4,836,065 | A | * | 6/1989 | Setliff | 81/124.2 |
| 4,867,272 | A | * | 9/1989 | Troubridge | 182/92 |
| 4,884,480 | A | * | 12/1989 | Briese | 81/128 |
| 4,934,221 | A | * | 6/1990 | Hsiao | 81/177.5 |
| 5,269,395 | A | * | 12/1993 | Lyzhoft et al. | 182/187 |
| 5,279,388 | A | | 1/1994 | Laughlin et al. | 182/92 |
| 5,732,793 | A | * | 3/1998 | Dech | 182/187 |
| 5,743,353 | A | * | 4/1998 | Browning et al. | 182/92 |
| D394,601 | S | | 5/1998 | Mesna et al. | D8/367 |
| 5,810,113 | A | * | 9/1998 | Jones | 182/92 |
| 5,881,837 | A | * | 3/1999 | Leicht | 182/90 X |
| 5,899,124 | A | * | 5/1999 | Cross, Jr. | 81/176.15 |
| 5,941,485 | A | * | 8/1999 | Davidson et al. | 248/218.4 |
| 5,944,139 | A | * | 8/1999 | Kozial | 182/92 |
| 5,967,475 | A | * | 10/1999 | Johnson | 248/217.4 |

* cited by examiner

*Primary Examiner*—Bruce A. Lev
(74) *Attorney, Agent, or Firm*—Boyle Fredrickson Newholm Stein & Gratz S.C.

(57) ABSTRACT

A portable step system for fastening to a member such as a tree includes a first rung having an integral first arm, a plate connected to the first arm, a second arm integral with a second rung connected to the plate, and a fastener for securing the step to the member. At least two weldments connect the plate to the first and second arms. The fastener is preferably a screw having a uniquely shaped head. The plate has a hole for receiving the screw. A tool having a hole shaped for receiving the head of the screw is used to tighten the screw. The rungs are preferably covered with an irradiative material to increase visibility during darkness and may also have an anti-slip surface. A method of using the step is also described.

22 Claims, 5 Drawing Sheets

TWO RUNG REMOVABLE STEP AND METHOD OF USING THE SAME

BACKGROUND OF THE INVENTION

1. Field of the Invention

The present invention relates in general to the field of removable support apparatus and a method of using the same. More particularly, the present invention relates to a two rung portable step.

2. Discussion of the Related Art

Historically, it was known in the prior art to use steps for climbing similar to the type hereunder consideration. Specifically in the past, hunters have used such steps to get up and down from their hunting tree perches or blinds. Conventional steps of these sort are shown in U.S. Pat. No. 5,944,139 to Kozial. It should be understood that Kozial discloses embodiments that were at least in-part satisfactory for the purposes for which they were intended. More particularly, Kozial discloses a tree step for climbing a vertical structure such as a tree. The step has a surface engageable portion connected to an attaching structure and an outer end with an upwardly facing surface. It also includes a luminescent member for radiating light upwardly from the upwardly facing surface in a vertical direction. A semi-rigid, semi-transparent cover structure that protects the luminescent member from an outside environment may also be included. However, Kozial discloses only single rung steps.

SUMMARY AND OBJECTS OF THE INVENTION

A primary object of the invention is to provide an apparatus that provides generally improved safety and stability. Another object of the invention is to provide an apparatus that is rugged and reliable. Another object of the invention is to provide an apparatus that has one or more of the characteristics discussed above but which is relatively simple to manufacture and assemble using a minimum of equipment. Still another object of the invention is to provide a step that is easy to use and can be attached to and removed from a member with a minimum of effort. Yet another object of the invention is to provide a system that has one or more of the characteristics discussed above but which is which is relatively simple to setup and use. In accordance with a first aspect of the invention, these objects are achieved by providing a removable step comprising a first arm, a plate connected to the first arm, a second arm connected to the plate, and a fastener connected to at least one arm.

In accordance with another aspect of the invention, these objects are achieved by providing a portable step system for attaching to a member comprising at least one step including a first rung, a first arm integral with the first rung, a triangular shaped plate connected to the first arm, a second arm connected to the plate, a second rung integral with the second arm, at least two weldments connecting the first and second arms to the plate, and a screw having a uniquely shaped head. The plate may include a hole for receiving the screw. A T-shaped fastening tool having a uniquely shaped hole receives the head of the fastener and is used to drive the screw into the member, thus securing the step thereto. The rungs of each step have an anti-slip surface and are covered with an irradiative material to increase visibility during darkness.

The inventive method of climbing a member using the step and system described above includes the steps of:

providing at least one step including a) two arms or rungs protruding in a first direction, b) a fastener and c) a fastening tool for engaging the step; engaging the fastener to the member; driving the fastener into the member in a second direction by applying torque to the fastening tool; leveling the step relative to the member, moving on the step to reach a different point along the member; and repeating these steps until a destination is reached along the length of the member. Additional features include: a bar connecting the first rung to the second rung; at least one rung having a textured surface to increase hold; at least one rung having a slightly bent outer portion.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
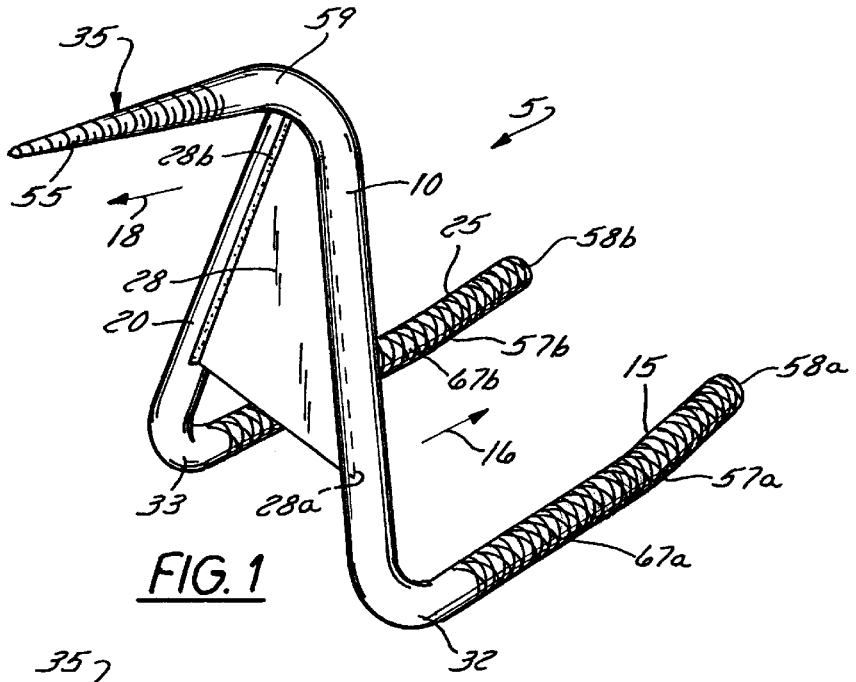
FIG. 1 is a perspective view of a step according to the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected" or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the embodiments described herein.

Specific embodiments of the present invention are further described by the following, non-limiting examples. The examples are intended merely to facilitate an understanding of ways in which the present invention may be practiced and to further enable those of skill in the art to practice the present invention. Accordingly, the examples should not be construed as limiting the scope of the present invention.

Figure 2:
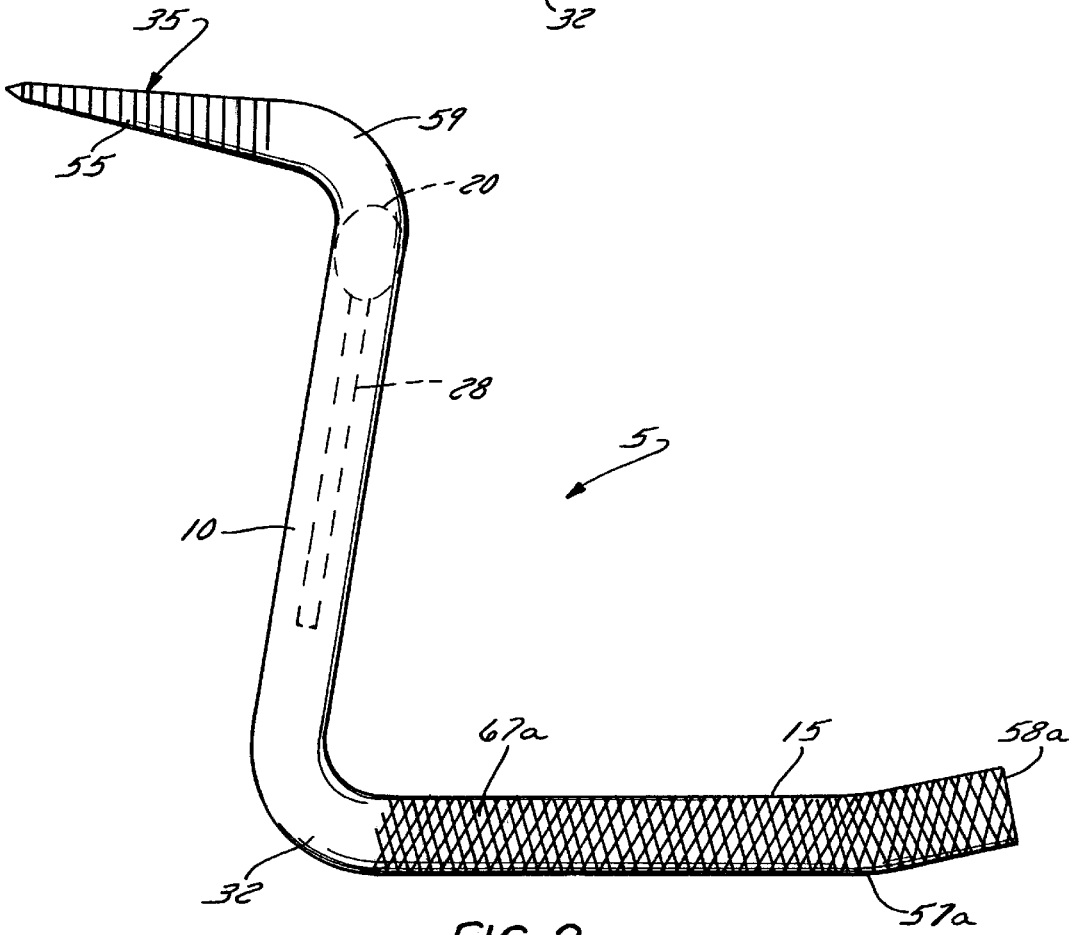
FIG. 2 is a side view of the step of FIG. 1.
Figure 3:
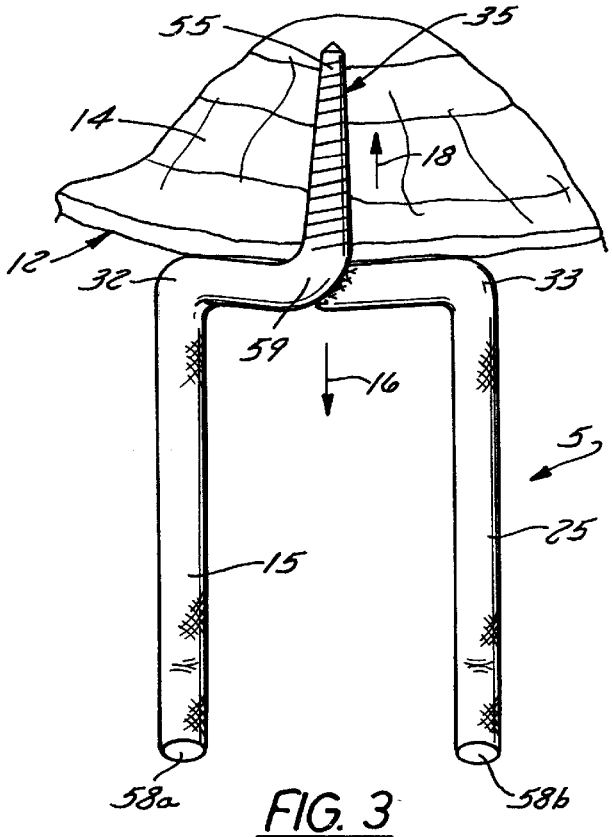
FIG. 3 is a partial cut away top plan view showing the step of FIG. 1 embedded into a tree.
Figure 4:
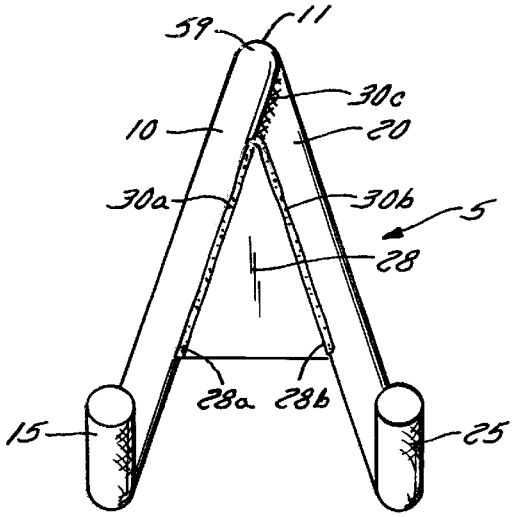
FIG. 4 is a bottom front perspective view of the step of FIG. 1.
Figure 5:
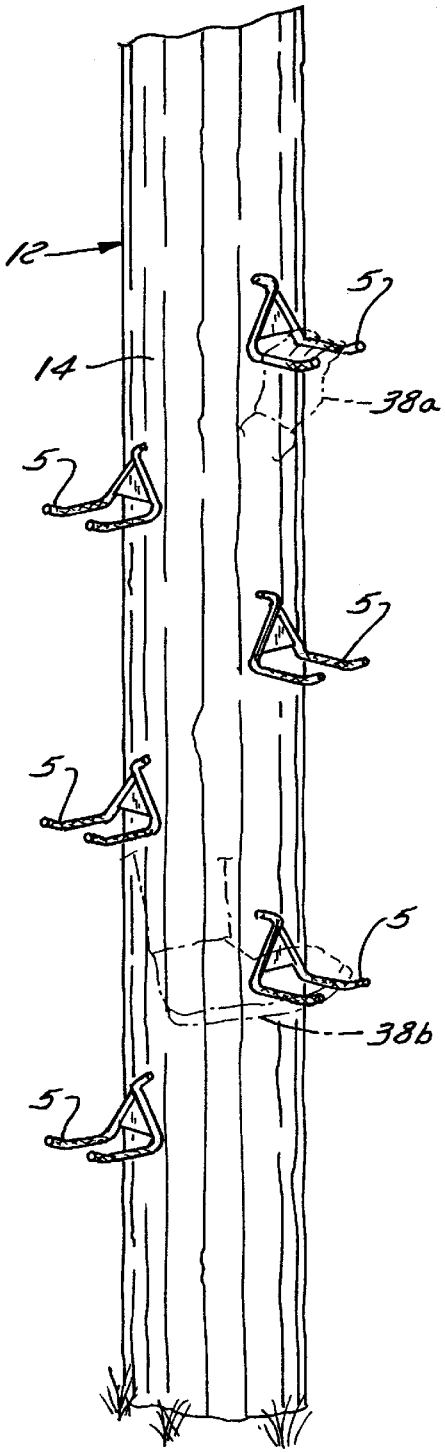
FIG. 5 is a reduced view of the step in FIG. 1 showing attachment to a vertical member such as a tree.
Figure 9:
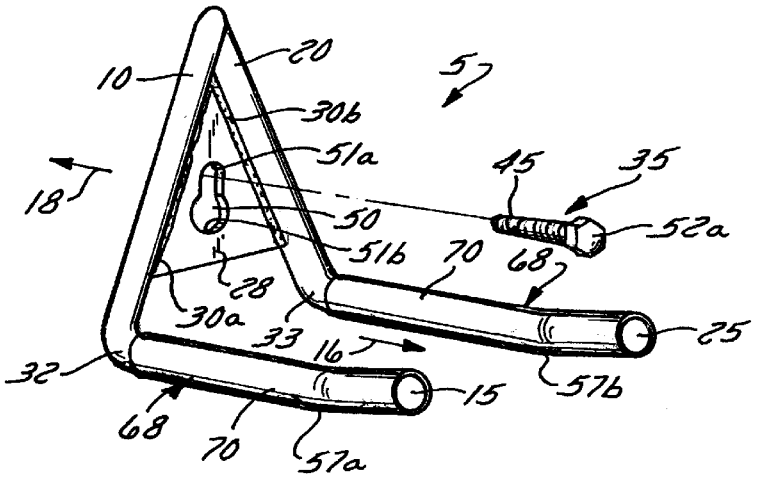
FIG. 9 is still another embodiment of the step of the present invention.
Figure 10:
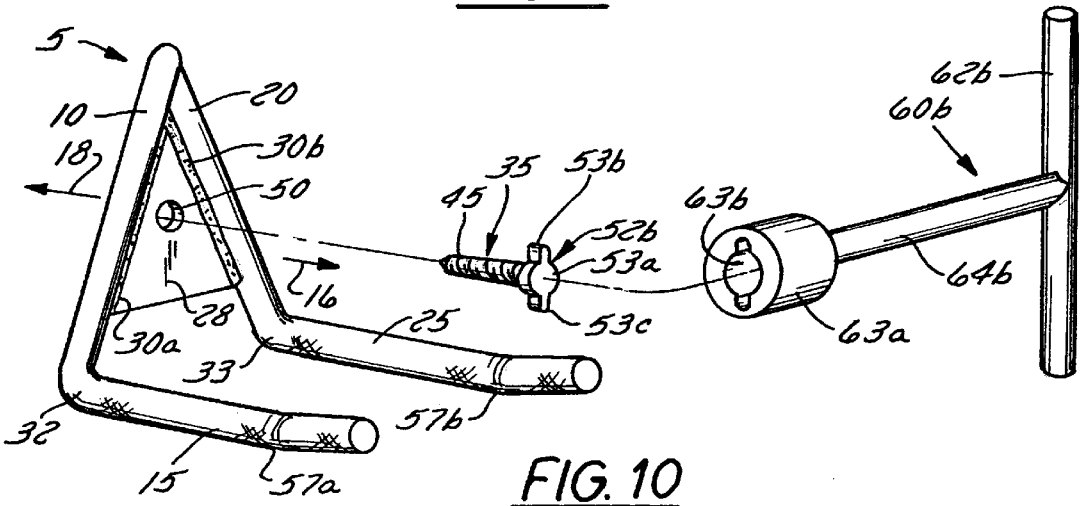
FIG. 10 is a perspective view of yet another embodiment of the present invention showing another fastening tool.
Figure 11:
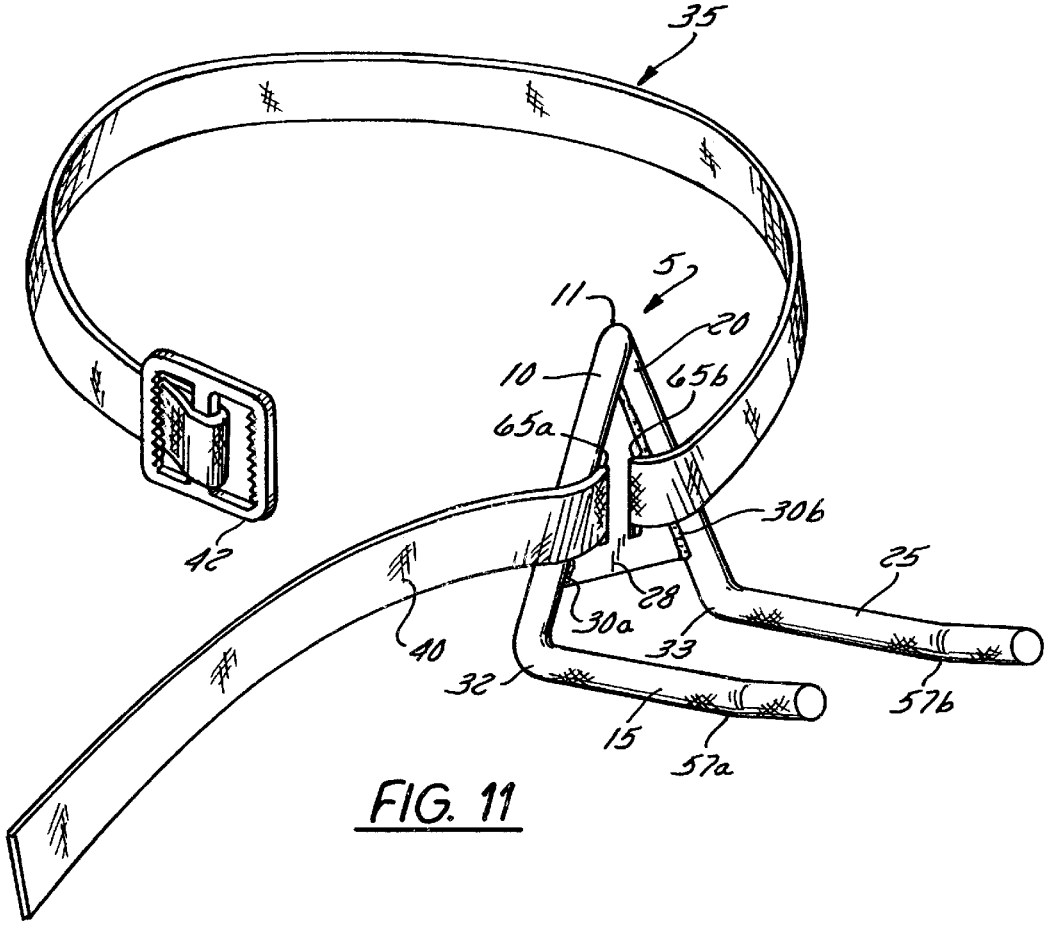
FIG. 11 is a another embodiment of the step of the present invention having a strap for a fastener.

As seen generally in FIGS. 1–11, an inventive portable step 5 is disclosed. The portable step 5 preferably has at least a first arm 10 and a second arm 20 connected to the first arm 10 at an apex 11 (FIGS. 4 and 11). The step 5 is preferably attached to a member 12 and used for moving across the surface of the member 12. In one preferred embodiment, the member 12 is a tree 14 and a multitude of steps 5 are used to climb up and down along the length of the tree 14 as shown in FIG. 5.

Referring to FIG. 1, the preferred embodiment, the step 5 is easily removable and the portable step 5 comprises a first arm 10, which is integral with a first rung 15, further includes a plate 28 having a first edge 28*a* and a second edge 28*b*. The plate 28 is connected to the first arm 10 along the first edge 28*a*. A second arm 20 is connected to the plate 28 along the second edge 28*b*.

A second rung 25 is preferably integral with the second arm 20. A fastener 35 is preferably connected to at least one arm (10 or 20) to ensure that the step 5 is securely fastened to the member 12.

In the preferred embodiment, the rungs 15, 25, plate 28, arms 10, 20 and fastener 35 are constructed from hardened steel. However, as will be explained later, one skilled in the art will realize that any of several alternative materials may be used.

In one preferred embodiment, the plate 28 has a triangular shape as best shown in FIG. 1. The plate edges 28*a*, 28*b* are connected along the inside surface of arms 10, 20 preferably by two weldments that extend along the length of the plate edges 28*a*, 28*b* as shown in FIG. 4. In one preferred embodiment, the first rung 15 and second rung 25 transversely protrude in a first direction 16 away from the plate 28. In that embodiment, the fastener 35 is a threaded extension 55 as best shown in FIGS. 1–3, and the threaded extension 55 protrudes in a second direction 18 opposite the rungs 15, 25.

In one preferred embodiment, the rungs 15, 25 are formed to prevent slippage. For example, knurling the surface 67*a*, 67*b* of the rungs 15, 25 provides texture to an otherwise smooth metal surface as best shown in FIGS. 1 and 2. Alternatively, as shown in FIG. 9, a coating 68 may be applied to the rungs 15, 25 for anti-slippage purposes. In one preferred embodiment, the coating 68 is a rubber sheath 70 that is dimensioned to tightly fit around rungs 15, 25 (see FIG. 9). Furthermore, in one preferred embodiment, rungs 15, 25 have a slightly, upwardly bent outer portion toward the end of the length of the rung. As shown in FIG. 2, the first rung 15 has a first bend 57*a* approximately ¼ of the length of the rung from end 58*a*. Similarly, as best shown in FIG. 1, the second ring 25 has a second rung bend 57*b* which is also located approximately ¼ the way up the rung 25 from the rung end 58*b*.

In the preferred embodiment, plate 28, first arm 10, and second arm 20 are constructed and arranged in such a manner so that the step 5 clings closely to the member 12 when weight is applied. For example, as best shown in FIGS. 1 and 2, preferably the arm 10, slopes gently inwardly in the direction of the extension 55 and then is bent in nearly a 90° angle in the opposite direction forming a first bend 32 as the first arm 10 connects to the first rung 15. Similarly, the second arm 20 slopes gently in the direction of extension 55 until it bends at second bend 33 in the opposite direction at nearly a 90° angle. This configuration and arrangement of the extension 55, the arms 10, 20 and the rungs 15, 25 allow the step 5 to better maintain stability relative to the member 12. This configuration also prevents the step 5 from shifting or slipping along the surface of the member 12. In one embodiment, flanges (not shown) may extend in the direction opposite of the protruding rungs 15, 25 to contact or engage the surface of the member 12 and thus better hold the step 5 in place.

As shown best in FIGS. 1 and 2, arms 10, 20 connect to an extension bend 59 which leads to the threaded extension 55 of the fastener 35. In the preferred embodiment, extension bend 59 is integral with the arm 10 as shown in FIG. 2. On the other hand, arm 20 is fixedly connected to bend 59 preferably by a weldment 30*c* as best shown in FIG. 4. As best shown in FIG. 3, threaded extension 55 is screwed into the member 12 (in this case tree 14) in the second direction 18 to rigidly affix the step 5 in place.

As shown in FIG. 5, a multitude steps 5 are preferably arranged approximately 2 feet apart in a staggered order by also screwing them securely to tree 14. The steps 5 are configured by alternating them from one side of the tree 14 to the other to make climbing the tree 14 easier. With a limited number of steps 5, it is possible to remove the steps when ascending the tree 14. The removed steps 5 would then need to be replaced when descending. To make replacing the steps 5 while descending easier, the bore from the removed step in the tree 14 made by the threaded extension 55 may be marked upon removal during ascension.

Figure 6:
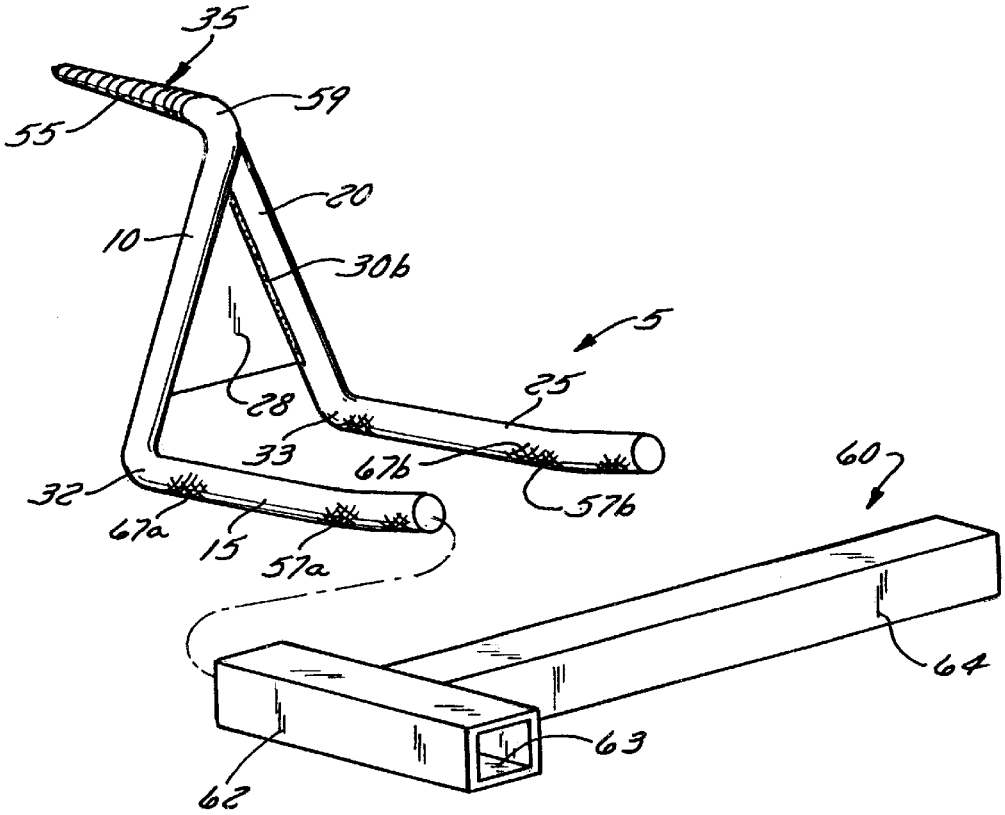
FIG. 6 is a perspective view showing the step of FIG. 1 with a fastening tool.
Figure 7:
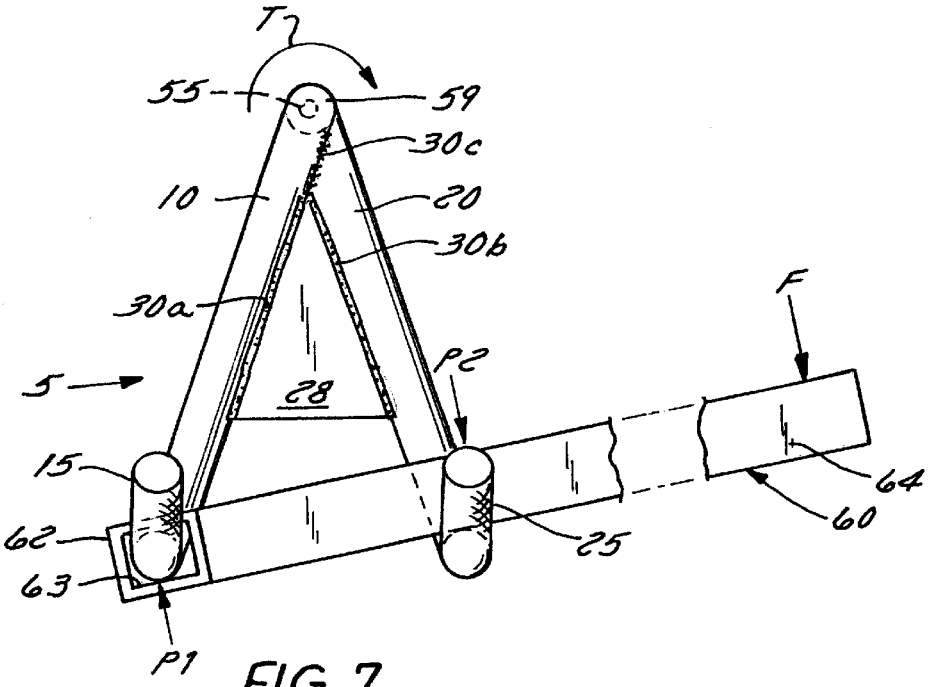
FIG. 7 is a bottom front perspective view of the step and fastening tool of FIG. 7.

As shown in FIG. 6, a fastening tool 60 may be used to quickly and conveniently fasten the step 5 to the member 12. In one preferred embodiment as shown in FIGS. 6 and 7, a handle 62 having a hole 63 is placed around rung 15. A shaft 64 is connected to the handle 62. As shown in FIG. 7, the handle 64 is preferably placed over the top of rung 25. Applying a force F to the shaft 64 puts pressure on rung 25 (P1) and rung 15 (P2) as shown. The pressure points (P1) and (P2) cause the step 5 to rotate, thus applying a torque (T) to the step 5 around extension 55. In this manner, the step 5 is fastened to the tree 14 as the extension 55 threads penetrate the tree 14 moving in the second direction 16 towards the tree 14 as shown in FIG. 3.

Figure 8:
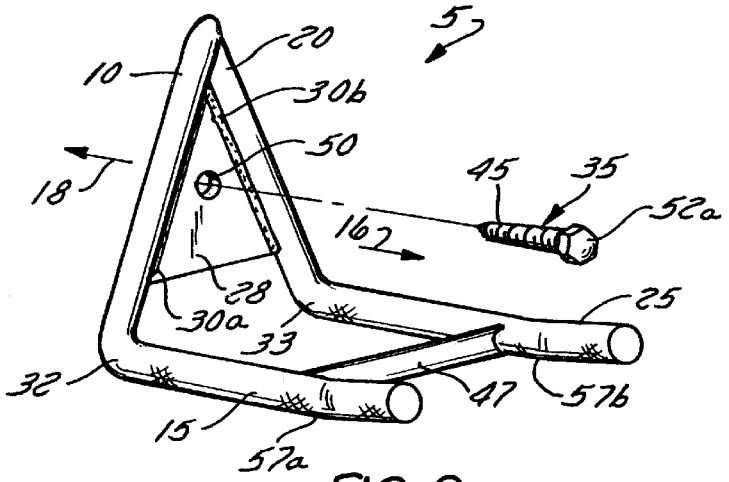
FIG. 8 is another embodiment of the step of the present invention.

In the embodiment shown in FIG. 8, fastener 35 consists of a threaded lag bolt 45 having a conventionally shaped head 52*a* which is hexagonal. In this embodiment, plate 28 is attached arms 10, 20 as shown by weldments 30*a* and 30*b*. Hole 50 is in approximately the center of plate 28. The round hole 50 is configured and dimensional to receive preferably a lag bolt 45. Applying torque to the lag bolt 45 with a conventional wrench (not shown) forces the lag bolt 45 in direction 18, and thus the step 5 is secured into a member (not shown).

Also shown in the embodiment of FIG. 8 is a rod 47 which connects rungs 15 and 25. The rod 47 is connected at a point slightly further up the rungs in the direction 18 than bends 57*a*, 57*b*. Preferably, rod 47 is welded to rungs 15, 25. Rod 47 may also have a knurled surface like the surfaces of rungs 15, 25 shown in the embodiment illustrated in FIGS. 1 and 2. In this embodiment the rod 47 may have a coating to prevent slippage. Preferably, the coating is made of rubber. As it would be difficult to add sheaths to the rungs 15, 25 and the rod 47 of this embodiment, the rubber coating is preferably added by a dipping process.

In FIG. 9, plate 28 has a hole 50 which has a smaller diametered upper portion 51 a and a larger diametered lower portion 51*b*. The shape of the hole 50 allows the lag bolt 45 to be screwed in through the hole 50 at the lower portion 51*b*. Plate 28 is then slid downwardly so that the lag bolt 45 is restrained by the upper portion 51*a*. When the user (not shown) wishes to remove the step 5 from the member (not shown), the plate 28 can be slid upwardly to align the larger diameter lower portion 51*b* with the bolt 45. Thus the plate 28 and the step 5 can be slid over the head 52*a* of the bolt 45. As described, the diameter of the lower portion 51*b* must be larger than the diameter of the head 52*a,* while the head 52*a* must have a larger diameter than the diameter of the upper portion 51*a*. This configuration allows for the easy removal of the steps 5 without having to remove the lag bolt 45 with a conventional wrench (not shown).

FIG. 10 illustrates another embodiment of step 5. The step 5 includes has a first arm 10 and a second arm 20 which has a connected plate 28. A hole 50 is in about the center of the plate 28. A special fastener 35 fastens the step 5 to a member (not shown). Fastener 35 consists of a lag bolt 45 having a uniquely-shaped head 52*b* with a round center portion 53*a* a first flanged portion 53*b,* and a second flanged portion 53*c* extending opposite the first flanged portion 53*b*. A T-shaped fastening tool 60*b* is also shown. The fastening tool 60*b* has a handle 62*b* which is connected to a shaft 64*b*. A shaft socket 63*a* is connected to the shaft 64*b*. The socket 63*a* has a uniquely-shaped hole 63*b* which is configured to receive the head 52*b*. The extending flanges 53*b* and 53*c* closely align with the dimensions of hole 63*b* of the socket 63*a*. Applying torque to the uniquely-shaped head 52*b* from the tool 60*b* having hole 63*b* allows the lag bolt 45 to tightly secure the step 5 to a member (not shown). The uniquely shaped head 52*b* also prevents the lag bolt 45 from being removed from the member with a conventional wrench. Once the lag bolt 45 is tightly secured, it is difficult to remove the bolt from a member 12 such as a tree 14 without having the specialized fastening tool 60b. Therefore, accordingly, the step 5 can remain in place unguarded without fear of theft.

FIG. 11 shows another embodiment of the inventive step. In this embodiment, step 5 includes arms 10, 20 which are connected to a plate 28 by weldments 30*a,* 30*b*. Two slots 65*a* and 65*b* are located in nearly the center of the plate 28. The slots 65*a,* 65*b* are roughly 2.5 cm long and run parallel to each other. A fastener 35 may be laced through the slots 65*a,* 65*b* as shown. The fastener 35 includes a strap 40 and a buckle 42 at one end. The fastener 35 (i.e., the strap 40 and buckle 42) can thus fasten the step 5 to a member (not shown) without physically penetrating a member. This embodiment is useful for use in national forests and other public lands which have strict rules and regulations against using steps which damage trees. Further, this embodiment may also be used in situations where the member is a metal utility pole which cannot easily be penetrated by a lag bolt or a threaded extension. Moreover, the strap 40 and buckle 42 configuration allows for quick removability of the step 5 without further requiring an additional fastening tool.

In one preferred embodiment, step 5 has rungs 15, 25 which are about 11 cm long, arms 10, 20 which are about 10 cm long, a plate 28 having sides 6 cm long and a base 4 cm wide, and an threaded extension 55 about 5 ½ cm long. The rungs, arms, and extension are made from rolled steel that is approximately 1 cm in diameter. The handle 62 of the tool 60 is preferably 7 cm long and the shaft 64 is about 23 cm long. The hole 63 in the handle 62 is about 1.25 cm in diameter so that it can easily receive the rung.

In one preferred embodiment as shown in FIG. 9, coating 68 is an irradiative material. This material could be a paint or in this example, a rubber covering 70. The irradiative nature of the material allows for increased visibility during darkness. For example, when hunting before sunrise or sunset in the autumn, steps to a deer blind are more easily and safely traversed if they provide a soft iridescent glow to the climber.

The disclosed embodiment shows a T-shaped tool as the structure for performing the function of attaching the inventive step to a tree, but the structure for the tool can be any other structure capable of performing the attaching function, including, by way of example a conventional adjustable wrench.

Conveniently, the step and tool of the present invention can be made of any material. For example, any castable or moldable plastic may be used for the production of the step, especially a high-impact plastic, e.g., polystyrene, ABS, or polycarbonate (PC) or some combination of these materials in an integrated or alloy form. Specifically, a mixture of ABS and polycarbonate (PC) plastic, preferably in a ratio between about 80 and 20 to 20 and 80 parts ABS and PC respectively, has been found particularly suitable. These plastic combinations are readily available in the art, although any other plastic or metal materials and alloys that provide suitable strength and stability may of course be employed.

All the disclosed embodiments are useful for the purpose of climbing a tree, wooden utility pole, metal streelight, bridge, or the like. Nonetheless, there are virtually innumerable uses for the present invention, all of which need not be detailed here. Moreover, all the disclosed embodiments can be practiced without undue experimentation.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept. For example, the stability of the step may be enhanced by providing additional rods and/or rungs. Similarly, although a rubber coating is preferred for its anti-slip properties, any material having such properties could be used in its place. In addition, the individual components need not be fabricated from the disclosed materials, but could be fabricated from virtually any suitable material.

Moreover, the individual components need not be formed in the disclosed shapes, or assembled in the disclosed configuration, but could be provided in virtually any shape and assembled in virtually any configuration. For example, the rungs as described and shown need not be present as one skilled in the art can imagine a step having only two arms, a connecting plate, and a fastener. Further, although the arm and the rung herein are described as physically separate modules, it will be manifest that they may be more thoroughly integrated to form a single element (referred to as merely an arm). The same is true for the plate as it could be integrated with the associated rungs/arms to form one element. Another example is that the strap could be directly attached to the arms and thus need not be connected to the plate as described. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended subclaims.

What is claimed is:

1. A removable step comprising:

a first arm;

a plate connected to the first arm;

a second arm connected to the first arm at an apex and connected to the plate;

a first rung integral with the first arm;

a second rung integral with the second arm; and a fastener connected to at least one arm and extending from the apex.

2. The step of claim 1, further comprising a rod connecting the first rung to the second rung.

3. The step of claim 1, further comprising at least two weldments for connecting the first and second arms to the plate.

4. The step of claim 1, wherein the fastener is a strap and a buckle.

5. The step of claim 1, wherein the fastener is a screw.

6. The step of claim 1, wherein the plate is triangular shaped, has at least one hole for receiving the fastener, and has a first edge and a second edge each connected to the first arm and the second arm, respectively.

7. The step of claim 1, wherein the rungs protrude transversely in a first direction away from the plate, and wherein the fastener is a threaded extension integral with one arm and protruding in a second direction opposite the first rung and the second rung.

8. The step of claim 7, wherein the first arm slopes gently inwardly in the direction of the extension and then is bent in nearly a 90° angle in the opposite direction forming a first bend as the first arm connects to the fit rug; and wherein the second arm slopes gently in the direction of extension until it bends at a second bend in the opposite direction at nearly a 90° angle.

9. The step of claim 1, wherein tat least one rung has a slightly bent outer portion.

10. The step of claim 1, further comprising an extension bend connected to at least one arm; and an extension connected to the extension bend.

11. The step of claim 1, wherein the fastener can attach the step to a metal pole member.

12. The step of claim 1, wherein the fastener can attach the step to a tree.

13. The step of claim 1, wherein the rungs are covered with an irradiative material to increase visibility during darkness.

14. The step of claim 1, wherein the rungs are formed to prevent slippage.

15. The step of claim 1, wherein the rungs are coated with rubber.

16. A portable step system for attaching to a member comprising;

a) at least one step including:

a first rung, a first arm generally perpendicular to the first rung;

a triangular plate connected to the first arm;

a second rung parallel to the first rung, a second arm generally perpendicular to the second rung, an angle at which the first and second arms connect, b) a fastener having a uniquely shaped head, wherein the plate has a hole for receiving the fastener; and c) a tool having a hole for receiving the head of the fastener, wherein the hole has a shape that is complementary to the shape of the fastener head.

17. The system of claim 16, wherein at least the rungs of the at least one step are covered with an irradiative material to increase visibility during darkness.

18. The system of claim 17, wherein the rungs of the at least one step have an anti-slip surface.

19. The step of claim 18, further comprising a rod connecting the first rung to the second rung.

20. The step of claim 18, wherein at least one rung has a slightly bent outer portion.

21. The step of claim 16, wherein at least one rung has a textured surface to increase hold.

22. A method of climbing a member comprising the steps of:

a) providing:

i) at least two steps each including a first rung;

a plate connected to the first arm;

a second arm connected to the first arm at an apex and connected to the plate;

a first rung integral with the first arm;

a second rung integral with the second arm; and a fastener connected to at least one arm arid extending from the apex;

ii) a fastening tool for engaging each of the steps;

b) engaging the fastener to the member;

c) driving the fastener into the member in a second direction by applying torque to the fastening tool;

d) leveling each of the steps relative to the member;

e) moving on each of the steps to reach a different point along the member;

f) alternating the steps from one side of the member to the other; and g) repeating steps b) through f) until a destination is reached along the length of the member.

* * * * *